US011274411B2

(12) United States Patent
Edelman

(10) Patent No.: US 11,274,411 B2
(45) Date of Patent: Mar. 15, 2022

(54) WALL PROTECTION ASSEMBLY

(71) Applicant: EDELMAN PROJECTS PTY LTD, Mysterton (AU)

(72) Inventor: David Edelman, Mysterton (AU)

(73) Assignee: EDELMAN PROJECTS PTY LTD, Mysterton (AU)

( * ) Notice: Subject to any disclaimer, the term of this patent is extended or adjusted under 35 U.S.C. 154(b) by 0 days.

(21) Appl. No.: 17/258,070

(22) PCT Filed: Jul. 5, 2019

(86) PCT No.: PCT/AU2019/050709
§ 371 (c)(1),
(2) Date: Jan. 5, 2021

(87) PCT Pub. No.: WO2020/010387
PCT Pub. Date: Jan. 16, 2020

(65) Prior Publication Data

US 2021/0164188 A1 Jun. 3, 2021

(30) Foreign Application Priority Data

Jul. 10, 2018 (AU) ..... 2018902499

(51) Int. Cl.
*E02D 5/60* (2006.01)
*E02D 5/14* (2006.01)
(Continued)

(52) U.S. Cl.
CPC ..... *E02D 5/60* (2013.01); *E02D 5/04* (2013.01); *E02D 5/14* (2013.01); *E02D 5/28* (2013.01);
(Continued)

(58) Field of Classification Search
CPC .... E02D 5/02; E02D 5/03; E02D 5/04; E02D 5/06; E02D 5/14; E02D 5/226;
(Continued)

(56) References Cited

U.S. PATENT DOCUMENTS 3,939,665 A 2/1976 Gosse et al.
4,019,301 A * 4/1977 Fox ..... E02D 5/60 52/834
(Continued)

FOREIGN PATENT DOCUMENTS

JP 56135610 A * 10/1981
JP 57155437 A * 9/1982 ..... E02D 31/06
(Continued)

*Primary Examiner* — Frederick L Lagmam
(74) *Attorney, Agent, or Firm* — Browdy and Neimark, PLLC

(57) ABSTRACT

A protection assembly for protecting a wall, comprising: a coating system for coating a portion of the wall; a flexible covering for covering the coating system, and having fixing portions at end regions of the flexible covering; and a wall anchor system, wherein, in use, the coating system is located between the flexible covering and wall anchor system, and the flexible covering is anchored, at the fixing portions, in a tensioned condition to the wall by the wall anchor system, so the flexible covering produces a force to press the coating system against the wall.

18 Claims, 4 Drawing Sheets

(51) Int. Cl.

| | |
|---|---|
| ***E02D 29/02*** | (2006.01) |
| ***E02D 31/06*** | (2006.01) |
| ***E02D 5/04*** | (2006.01) |
| ***E02D 5/28*** | (2006.01) |

(52) U.S. Cl.
CPC ..... *E02D 29/02* (2013.01); *E02D 31/06* (2013.01); *E02D 2200/1607* (2013.01)

(58) Field of Classification Search
CPC ..... E02D 27/30; E02D 29/02; E02D 29/0258; E02D 29/0266
USPC ..... 405/211.1, 274, 276, 279, 284, 285
See application file for complete search history.

(56) References Cited

U.S. PATENT DOCUMENTS 4,561,804 A * 12/1985 Weatherby ..... E02D 29/02 405/262
5,435,667 A 7/1995 Strange
2012/0177445 A1* 7/2012 Wendt ..... E02D 5/28 405/211.1
2015/0197909 A1* 7/2015 Huh ..... E02D 29/02 405/270
2015/0239199 A1 8/2015 Weber
2018/0266065 A1* 9/2018 Leichti ..... F16B 33/008

FOREIGN PATENT DOCUMENTS

| | | | | | |
|---|---|---|---|---|---|
| JP | 58127838 | A | * | 7/1983 | ..... E02D 31/06 |
| JP | 62072825 | A | * | 4/1987 | |
| JP | 62099520 | A | * | 5/1987 | |
| JP | 62194329 | A | * | 8/1987 | |
| JP | H01298186 | A | | 12/1989 | |
| JP | 02205691 | A | * | 8/1990 | |
| JP | 02221513 | A | * | 9/1990 | ..... E02D 31/06 |
| JP | 02232415 | A | * | 9/1990 | |
| JP | 03290516 | A | * | 12/1991 | ..... E02D 31/06 |
| JP | 05247960 | A | * | 9/1993 | |
| JP | 2004137801 | A | | 5/2004 | |
| JP | 2007113230 | A | * | 8/2007 | |
| JP | 2012140796 | A | * | 7/2012 | |
| JP | 201117186 | A | | 8/2012 | |
| JP | 2016008502 | A | | 1/2016 | |
| JP | 2018105052 | A | * | 7/2018 | |
| WO | 9009488 | A1 | | 8/1990 | |
| WO | WO 90/09488 | | * | 8/1990 | |

* cited by examiner

WALL PROTECTION ASSEMBLY

BACKGROUND OF THE INVENTION

The present invention relates generally to a protection assembly for protective covering of a steel sheet pile wall, and may relate more particularly to a protection assembly for preventing corrosion of steel sheet pile walls in marine environments.

DESCRIPTION OF THE PRIOR ART

Steel sheet pile systems are commonly used in marine environments such as ports, docks and channels to construct walls, which extend above and below the water level, and retain land or soil on one side and water on the other. The near-vertical face provided by the sheet pile wall provides a convenient geometry for vessels to approach the wall, in comparison to sloped rock walls or natural shoreline. Sheet piles are long structural steel sections, typically driven into the underlying ground and interlocked along a vertical joint to create a continuous wall. A variant of sheet pile walls is the combined wall consisting of sheet piles and tubular steel piles, or other variants, interlocked together.

Sheet pile walls sometimes include tie-backs, waling beams or other elements as part of their design. Tie backs are commonly steel rods that anchor the wall within the soil on the land side. They commonly have a threaded end that protrudes through the sheet pile wall and is retained with a plate and nut on the water side of the sheet pile wall. The inclusion of waling beams and other structural elements located on land-side of the wall may also include bolts, plates and other fixings on the water side of the sheet pile wall. The water-side face of a sheet pile wall is commonly referred to as the outside face or outer surface.

Steel sheet piling and fixings will corrode in a marine environment if not protected by a corrosion protection system. This corrosion will result in loss of thickness of the steel and may lead to loss of integrity and failure of the sheet pile wall. Existing corrosion protection systems commonly used include paint coatings and concrete encasement.

Regular, hollow cylindrical piles that are discreet and not joined into a wall are commonly protected by the layered application of an anticorrosive gel, a cloth or foam material impregnated with an anticorrosive gel and a flexible protective covering that wraps around the material and is attached back onto itself, to ensure that the anticorrosive gel or material is pressed against the steel surface of the pile.

Because the pile is circular in cross-section and the protective covering is applied around the full circumference, the protective covering typically holds the anticorrosive material against the steel surface by the application of pressure induced by hoop tension in the protective covering, or by hoop tension in a series of straps that hold the protective covering in place.

These systems described above are sometimes used on discrete piles that are not circular in cross-section and may have concave features, such as H-piles. In these cases a semi-rigid material may be used between the protective covering and the anticorrosive gel or impregnated cloth material to fill the gap therebetween.

The above system cannot be used on sheet pile walls because it is not possible to extend the protective covering around the circumference of the wall elements, for the opposite ends to be brought together to induce hoop tension in the protective covering.

In addition, rigid covers for sheet pile walls have been proposed. These covers are designed to have a shape following the exact profile of the wall. In the event of mismatch in shape or minor variations in dimensions due to manufacturing, voids may be created where the wall is exposed to the environment. Such covers also create voids around wall fittings, and portions of the wall can become exposed depending on weather and sea temperature due to different rates of thermal expansion of the wall and cover. Another drawback of such rigid covers is that they must be constructed of a high stiffness, corrosion resistant (i.e. expensive) material.

Thus there exists a desire or need for an assembly or method for protecting a wall, particularly a sheet pile wall, from environmental impacts, such as those imposed by a marine environment.

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

SUMMARY OF THE PRESENT INVENTION

In one broad form an aspect of the present invention seeks to provide a protection assembly for protecting a wall, comprising: a coating system for coating a portion of the wall; a flexible covering for covering the coating system, and having fixing portions at end regions of the flexible covering; and a wall anchor system, wherein, in use, the coating system is located between the flexible covering and wall anchor system, and the flexible covering is anchored, at the fixing portions, in a tensioned condition to the wall by the wall anchor system, so the flexible covering produces a force to press the coating system against the wall.

In one embodiment the fixing portions are anchored to the wall at spaced apart locations.

In one embodiment the flexible covering comprises a flexible sheet, and the end regions are opposed ends of the flexible sheet.

In one embodiment the flexible covering comprises one or more straps, and each of the fixing portions comprises a respective one of two opposed ends of each strap of the one or more straps.

In one embodiment the flexible covering further comprises a flexible sheet held, in use, against the coating system by the one or more straps, and wherein the one or more straps are tensioned to produce at least a part of the force to press the coating system towards the wall.

In one embodiment each strap of the one or more straps comprises: two sections, each section comprising one of the respective two opposed ends; and a buckle connecting the sections, the strap being operable to draw at least one of the sections through the buckle to apply tension to the respective strap.

In one embodiment the wall anchor system is connected to the end regions of the flexible covering and operable to apply tension to the flexible covering.

In one embodiment the fixing portions are tensioned in divergent directions.

In one embodiment the wall anchor system comprises: two elongate members each fixed, in use, to the wall at spaced apart locations; and a plurality of fasteners associated with each elongate member and being for fastening one of the fixing portions to the respective elongate member at spaced locations along the respective elongate member.

In one embodiment the protection assembly is for protecting the wall from a marine environment, the wall being elongate in a horizontal direction and the fixing portions being anchored, in use, at spaced apart locations in the horizontal direction.

In one embodiment the wall is non-planar, and the coating system is shaped so that the flexible covering applies force to press the coating system against the wall along a full length of the flexible covering.

In another broad form an aspect of the present invention seeks to provide a method for protecting a wall, comprising: applying a coating system to a portion of the wall; covering the coating system with a flexible covering having fixing portions at end regions of the flexible covering; and anchoring the flexible covering, at its fixing portions, to the wall in a tensioned condition using a wall anchor system so the flexible covering produces a force to press the coating system against the wall.

In one embodiment anchoring the flexible covering at its fixing portions comprises anchoring the fixing portions to the wall at spaced apart locations.

In one embodiment anchoring the flexible covering at its fixing portions comprises tensioning the flexible covering in divergent directions.

In one embodiment tensioning the flexible covering comprises operating the wall anchor system to apply tension to the flexible covering.

In one embodiment the flexible covering comprises one or more straps, each strap comprising two opposed ends, each fixing portion comprising one of the opposed ends, and anchoring the flexible covering comprises: attaching the one or more straps to the wall anchor system; and tightening the one or more straps.

In one embodiment the flexible covering further comprises a flexible sheet and covering the coating system comprises covering the coating system first with the flexible sheet and then holding the flexible sheet to the coating system using the one or more straps.

In one embodiment the method is for protecting the wall from a marine environment, the wall being elongate in a horizontal direction, wherein the wall anchor system comprises: two elongate members; and a plurality of fasteners associated with each elongate member, for fastening one of the fixing portions to the respective elongate member at spaced locations along the respective elongate member, wherein anchoring the flexible covering comprises: fixing the two elongate members to the wall at spaced apart locations; and fastening one of the fixing portions to the respective elongate member using a respective one of the pluralities of fasteners.

In one embodiment the method further comprises shaping the coating system so that the flexible covering applies force to press the coating system against the wall along a full length of the flexible covering.

In another broad form an aspect of the present invention seeks to provide a method of protecting one or more wall fittings, comprising: performing the above described method; shaping the flexible covering to fit around one or more wall fittings; providing an encasement shaped to be received over the one or more wall fittings and over an outer surface of a protection assembly component, the protection assembly component being one or more of the flexible cover, coating system and wall anchor system; and fitting the encasement to the outer surface of the protection assembly component.

It will be appreciated that the broad forms of the invention and their respective features can be used in conjunction, interchangeably and/or independently, and reference to separate broad forms is not intended to be limiting.

BRIEF DESCRIPTION OF THE DRAWINGS

Various examples and embodiments of the present invention will now be described by way of non-limiting example and with reference to the accompanying drawings in which: —

DETAILED DESCRIPTION OF THE PREFERRED EMBODIMENTS

Figure 1:
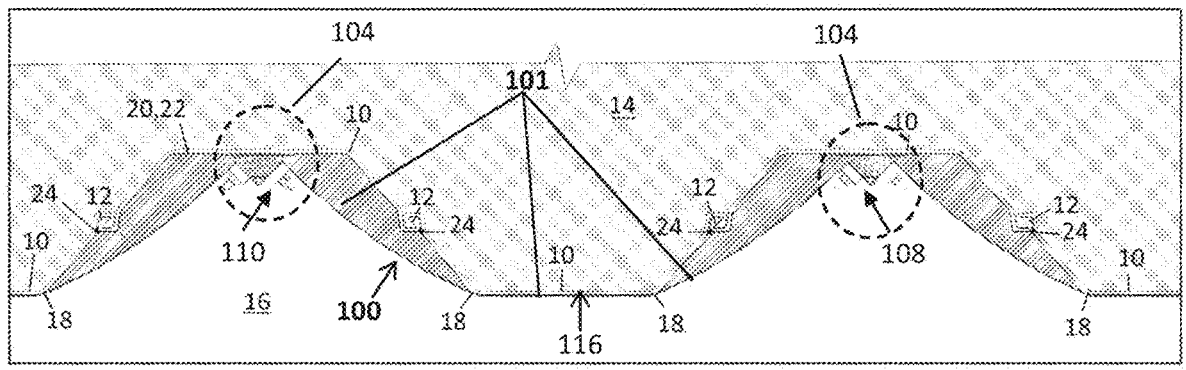
FIG. 1 is a cross-sectional view of an assembly in accordance with present teachings.

The protection assembly and related methods described in various embodiments herein is intended to protect a wall, or portion of a wall, from an environment. The protection assembly and method may be particularly useful in marine environments. In some embodiments, a method is provided for preventing corrosion of a steel sheet pile wall by application and retention of an anticorrosive gel, being part of a coating system, against the outside face of a sheet pile wall. The anticorrosive gel is typically petroleum or petrolatum based and prevents corrosion by preventing oxygen and water from reaching the steel surface of the sheet pile wall. The protection assembly may be directed toward ensuring that the anticorrosive gel is kept in intimate contact with the outside face of the steel sheet pile wall and is not removed through the action of waves, water, abrasion or other actions. The embodiments described herein include several elements and features intended to prevent disturbance of the anticorrosive gel layer.

It will be understood from the present disclosure that protecting a wall may refer to protecting part of the wall, rather than the wall in its entirety. Therefore, the phrases "protecting a portion of a wall" and "protecting a wall" will be understood to have similar meaning, namely referring to the relevant part of the wall (i.e. the part likely to be adversely affected if not protected), unless context dictates otherwise. Similarly, the term "a portion of a wall" and similar may refer to all or part of a wall, and will generally refer to protection on the outer surface of that wall unless context dictates otherwise. The outer surface is the surface facing the environment from which the protection assembly gives protection. It will be appreciated that some portions of the wall are not exposed to the environment, or are exposed inconsistently so that there is a lesser need to use a protection assembly in accordance with present teachings, for protecting those portions. For example, in a marine environment, a portion of a wall that is regularly below water level and/or is periodically submerged by normal tidal or wave movement, will require more protection than portions of the same wall that are sufficiently elevated to avoid the usual impact of waves.

In the following description, a number of materials are identified as suitable for various facets of the implementations. These materials are to be treated as exemplary and are not intended to limit the scope of the claims.

In the following description embodiments of the invention are described as being applied to sheet pile walls, such as steel sheet pile walls. Embodiments of the invention may also be applied to combined and other types of walls. Combined walls are used in the same general applications as sheet piles, though where additional or different structural properties are required. Combined walls may consist of sheet piles interlocked together with tubular piles, or sections that are similar to regular sheet piles on the outside face but have an additional section on their rear face, and join together in the same manner as sheet piles—e.g. HZ piles. Accordingly, references herein to sheet piles or sheet pile are not intended to limit the scope of the claims with regard to use of the protection assembly on combined walls.

An example of a protection assembly for protecting a wall, will now be described with reference to FIG. 1. The protection assembly 100, interchangeably referred to as assembly 100, is applied to the outside face or surface of a sheet pile wall 10. Sheet pile wall 10 is composed of individual piles joined at joints 12. The sheet pile wall 10 retains soil 14 on one side and is exposed to the water and atmosphere 16 on the other side referred to as the outside of the sheet pile wall 10.

The protection assembly 100 broadly comprises a coating system 102, flexible covering 50 and wall anchor system 104.

The coating system 102 is for coating a portion of the wall 10. As mentioned above, the portion of the wall 10 may be the entirety of the wall, or only a part of the wall such as that part which is impacted by an environment from which it is desirable to protect the wall. The coating system 102 shown in FIG. 1 includes a number of different layers. The layers are applied to the outside face of the sheet pile wall. The layers include a barrier material layer, presently comprising anticorrosive gel layer 20, a tape layer 22 that may contain further barrier material, and a rigid or stiff shaping layer, presently comprising a rigid foam layer 40.

The anticorrosive gel layer 20 is applied to the outside face of the wall 10. The anticorrosive gel of layer 20 is typically petrolatum based. However, the layer 20 may instead be formed using another suitable barrier material—i.e. a material the presence of which, on the outer surface of the wall 10, prevents impact from the environment 16 on that outer surface—which may be a flowable material at least at the time of application to the wall 10. Such flowable materials may have no fixed shape, such that they can be taken from a volume (e.g. a can or vat) and spread over the outer surface of the wall. In the present context, other gels such as hybrid petrolatum gels, and some waxes may be suitable for use in forming layer 20.

The tape layer 22 comprises a tape of cloth material or foam. The tape is typically a non-woven cloth. The layer 22 may further comprise barrier material, e.g. petrolatum material, impregnated into the cloth prior to application to the wall 10. The material impregnating the cloth may be the same material as that which forms layer 20, or a different material as needs be. The cloth and impregnating material together produce a product with a thickness of typically between 1 mm and 3 mm, that may be supplied on a roll.

The tape layer 22 may be replaced by any other material, for example a broad sheet of material of sufficient flexibility to be shaped to conform to the shape of the outer surface of the wall 10.

Where the layer 22 is impregnated with barrier material, there may be no need to provide layer 20. Thus, the coating system 102 may, in some embodiments, include only one of layers 20 and 22.

In the examples shown in the figures the wall 10 is non-planar. The outer surface of wall 10 comprises various angles and, for composite or combined walls, changes in cross-section. The angles and changes in cross-section assist with distributing force into the soil 14, provide structural strength and stability against force from water, particularly waves, bearing against the wall 10 and reaction forces from the soil 14. However, if the flexible cover 50 is tensioned over angled sections of the wall 10 there may, for some sheet pile wall designs, be voids created behind the flexible cover. Water may flow into those voids and dislodge layer 22 and/or wash away layer 20. The effectiveness or longevity of the protection assembly 100 may be reduced.

The protection assembly 100 should therefore accommodate angles and changes in cross-section in a horizontally elongate wall, while maintaining the pressure against layer 20 and/or 22 to avoid the creations of voids. To achieve this, the coating system 102, particularly layer 40, is shaped to remove voids between the flexible covering 50 and wall 10, to enable the flexible covering 50 to be tensioned over the coating system 102, around changes in the shape of the wall 10, while maintaining pressure on layer 20 and/or 22. Layer 40 ensures force or pressure from the flexible covering 50 is applied over more of, or the entirety of, the outer face of the portion of the wall 10 covered by the flexible cover 50.

Layer 40 assists in ensure the force or pressure applied by the flexible covering 50 is applied across the outer face of the wall 10. To that end, layer 40 is shaped so that the side facing the sheet pile wall 10 follows the profile of the sheet pile wall 10. The outside of the layer 40 is shaped to provide a convex curve between the edge of the wall anchor system 104 (particularly spine 30) and the outside corner 18, seen on FIG. 1, of the sheet pile wall 10. The curve may be continuously convex, or may generally convex (e.g. may include one or more flat portions). However, in the embodiment shown, concave sections are avoided.

Figure 3:
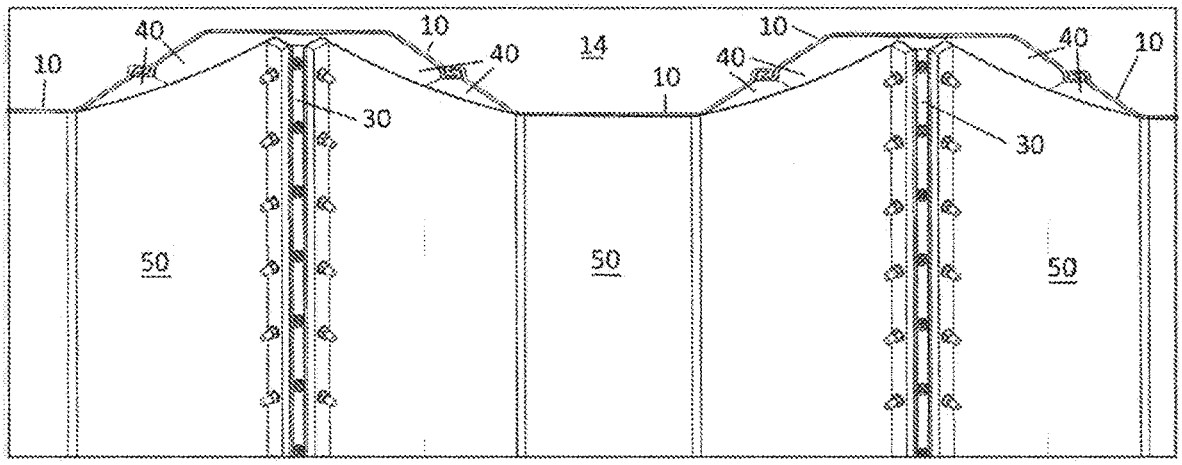
FIG. 3 is an isometric view of the assembly of FIG. 1, applied to a sheet pile wall.

The layer 40 is formed from foam which may be rigid. The layer 40 may be constructed of expanded polystyrene. The layer 40 may be segmented into two or more section shapes as shown in FIG. 3. This segmentation allows easier installation and enables better matching of the profile of the sheet pile wall in the vicinity of some features—e.g. joints between sheets of the wall 10—and can help account for slight dimensional variations between sheets of the wall 10 due to manufacturing and installation tolerances. The layer 40 may also be supplied in convenient lengths to simplify the installation. Those lengths may match the width of the flexible covering 50 (i.e. its vertical height when the flexible covering 50 extends laterally/horizontally across the wall 10 between fixing portions as best seen in FIG. 3), or the width of the flexible sheet 50 may be a whole number multiple of the length of the segments of layer 40.

While in the embodiment in FIG. 1 layer 40 comprises a rigid foam 40, other types of rigid or stiff filler may be used. The rigid foam may be expanded polystyrene. In some embodiments, the layer 40 may have barrier material resident in the voids in the layer 40, such as voids in the rigid foam. This may provide sufficient barrier material to protect the wall 10 without the need for one or both of the layer 20 and layer 22. The coating system 102 may therefore include any one or more of layers 20, 22 and 40, in any combination, as appropriate for a particular application.

The flexible covering 50 covers the coating system 102. The flexible covering 50, interchangeably referred to as a protective covering, consists of a flexible sheet 52 and fixing portions, presently each a rigid flange 54, at ends or end regions generally designated 106. The sheet 52 and flange 54 may both be constructed of high density polyethylene and are preferably bonded together by a plastic weld 56. The fixing portions 54 are portions of the flexible covering 50 by which the flexible covering connects to the wall 10 via wall anchor system 104.

The sheet 52 may be of around 3 mm thickness. The flexible sheet 52 may be made of high density polyethylene, or a fabric reinforced polymer, and the flange 54 may be constructed of a strong rigid material such as fiberglass. In this embodiment the flange 54 may be circular in cross-section and will typically be retained by wrapping the sheet 52 around the flange and joining it back upon itself by sewing. Other embodiments of the protective covering 52 are possible.

The flange 54, or other fixing portion as may be used in accordance with present teachings, attaches the flexible covering 50 to the wall 10 via wall anchor system 104. When anchored to the wall 10, the flexible covering 50 is in a tensioned condition—i.e. is under tension. The covering 50 generally forms a curve as shown in FIG. 1, and thus has a radius—the radius may vary along the flexible covering 50. Therefore, the tension in the covering 50—which may be referred to as hoop tension—produces a force (which may be a radial force) in the direction of the wall 10. That force presses the coating system 102, which is between or interposes the flexible covering 50 and wall 10, against the wall 10.

The wall anchor system 104 is attached to the wall 10 at spaced apart locations 108 110. The fixing portions 54 are anchored to the wall 10, by wall anchor system 104, at spaced apart locations 108, 110. Therefore, the fixing portions 54, and thus the flexible covering 50, are attached to the wall 10 at spaced apart locations 108, 110.

The flexible or protective covering 50 is preferably sized so that the distance between the faces of the two flanges 54—i.e. the side 112 shown facing the wall 10 in FIG. 2 when the flexible covering 50 is anchored to the wall 10—is slightly smaller than the distance between the respective mating faces 120 on the wall anchor system 104 (on respective adjacent spines 30 of the wall anchor system 104 at locations 108, 110 as discussed below) when measured along an arc following the outside of layer 40 and the flat face 116 of the sheet pile wall 10 between portions of the layer 40 in the embodiment in FIG. 1.

The flexible covering 50 is attached to the wall anchor system 104 by fasteners 60. When the fasteners 60 are tightened, the flange 54 of the flexible covering is brought into contact with the mating face 120 of the wall anchor system 104, or spine 30 thereof—while the phrase "the flange 54 of the flexible covering 50 is brought into contact with the mating face 120" implies direct contact, that phrase, and similar phrases used herein, include within their scope indirect contact as required by context. For example, the flange 54 may contact the spine 30 by application of pressure through the sheet 52.

Due to its shorter length, the protective covering 50 is caused to deform—e.g. stretch—over its length. This deformation may be a combination of plastic and elastic deformation. The sheet 52 of the protective covering 50 will be in tension along its length and, due to its convex path, this tension will exist as a hoop tension and, therefore, exert a pressure against the rigid foam 40. This pressure will cause the rigid foam to be pressed toward the surface of the sheet pile wall 10. This action causes the tape 22 and anticorrosive gel 20 to be pushed against the surface of the sheet pile wall 10. This pressure displaces water and fills voids—e.g. by pressing anticorrosive gel layer 20 thereinto. The tape 22 and gel 20 are thus reliably retained against the surface of the sheet pile wall 10 and are not removed by wave, weather or other expected actions. Corrosion to the steel sheet pile wall 10 is thus prevented.

As the wall 10 is elongate, rather than having a generally circular cross-section, the flexible covering 50 cannot wrap around and attach back onto itself in order to be tensioned. To ensure proper engagement between the flexible covering 50 and wall 10, the flexible covering 50 is attached to the wall 10 via wall anchor system 104. In the present embodiment, the wall anchor system 104 includes fasteners 60 by which to attach the wall anchor system 104 to the flexible covering 50. The wall anchor system 104 is connected to the end regions 106 of the flexible covering 50 and is operable, by tightening the fasteners 60, to apply tension to the flexible covering 50 during anchoring.

In alternative embodiments, the fasteners 60 or other features may form part of the flexible covering 50 and be adapted to tighten onto the wall anchor system 10 to apply tension to the flexible covering 50. Other means for connection may be used and, in some embodiments, one end region of the flexible covering 50 may be attached to the wall and tension is then applied at the opposite end region to create tension across the flexible covering 50.

The wall anchor system 104 comprises two members, presently embodied by and hereinafter referred to as spines 30, to attach to respective end regions 106 of the flexible covering 50. The flexible covering 50 attaches to the wall 10 through or via the spines 30, which are located at spaced apart locations 108, 110 along the wall 10. The end regions 106 of the flexible covering 50 each extend along an edge of the covering 50. Accordingly, the members or spines 30 extend along opposite end regions 106.

The spines 30 may be supplied in convenient lengths to simplify the installation. For example, the spines 30 may be supplied to have equal length to the end regions 106—the length being evident as the elongate dimension of the spines 30 in FIG. 3.

Each spine 30 is installed prior to the protective covering 50 and simplifies the installation thereof. The spine 30 may be installed after the layer of barrier material 20, and/or after the layer of cloth or tape 22 is applied to the wall 10. Therefore, layer 20 and/or layer 22 extend behind the spine 30. To reduce wear of the layer 20 and/or 22, which may otherwise occur as, for example, tidal forces batter the flexible covering 50 resulting in minor movements of the spine 30, a flexible skirt 34 is installed between the spine 30 and the tape 22 as shown in FIG. 1. This skirt 34 may be omitted but provides additional protection to the tape 22 in this area. The skirt 34 may be constructed of high density polyethylene with a thickness of around 2 mm and may be bonded to the spine 30 by plastic welding or other methods.

Figure 2:
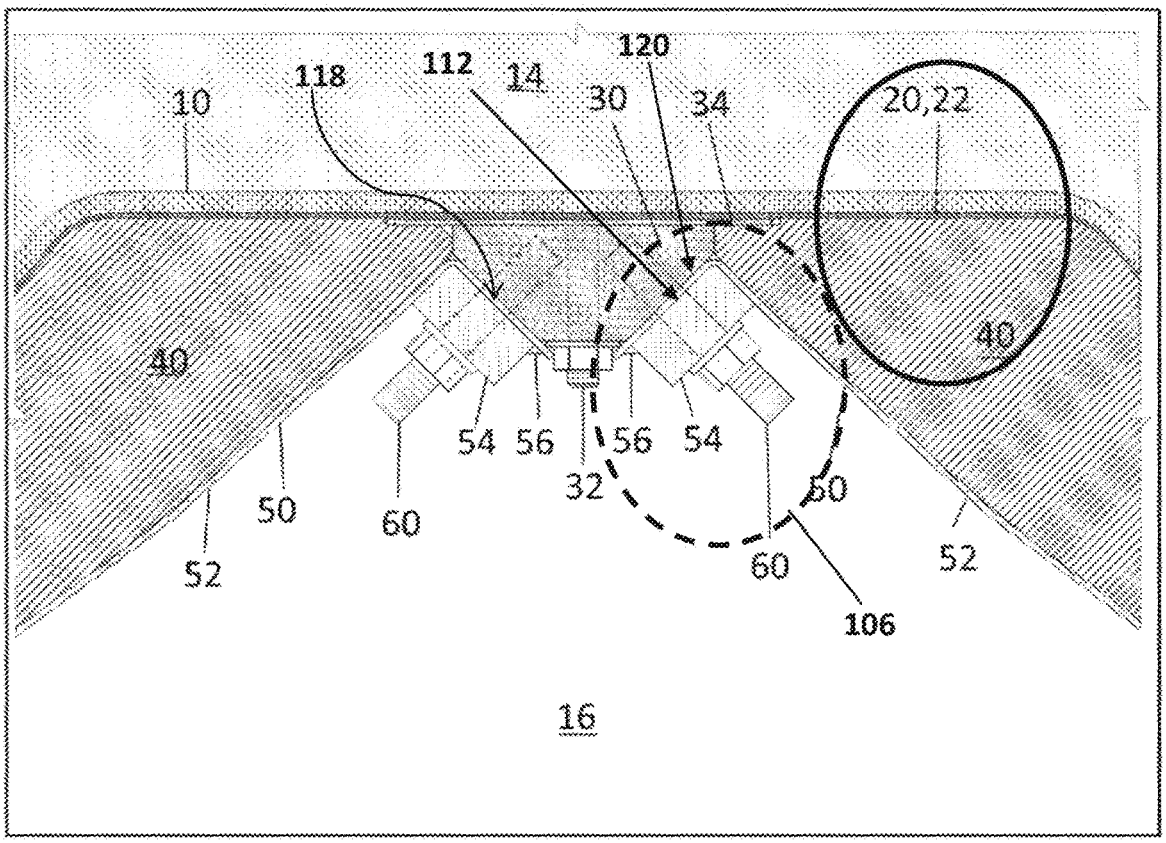
FIG. 2 is a closer, detailed cross-sectional view of one area of the assembly shown in FIG. 1.

Referring to FIG. 2, the spine 30 consists of a rigid material that may be high density polyethylene. The spine 30 is fastened to the sheet pile wall with mechanical fasteners 32 which pass through holes in the spine 30, and holes in the skirt 34 if a skirt is used. In the preferred embodiment in FIG. 2, the mechanical fasteners 32 are stud bolts that are welded to the sheet pile wall with nuts and washers to retain the spine 30. Other methods of fastening may be used such as blind bolts installed into prepared holes in the sheet pile wall 10, bolts into tapped holes or self-tapping screws. The fasteners are preferably constructed of a corrosion resistant material that is preferably marine grade stainless steel.

The spine 30 preferably bears against the wall 10 in water-tight engagement therewith. This is to prevent ingress of water, sand and contaminants behind the spine 30 and thus behind the flexible covering 50.

Each spine 30 has angled faces 118, 120. Each angled face 118, 120 is adapted to connect to a respective fixing portion of the flexible covering 50. The angles of the angled faces 118, 120 of the spine 30, relative to the wall 10, may be altered to suit the geometry of the particular sheet pile wall 10, the angle at which the flexible covering 50 approaches the spine 30, the type of fixing portion provided on the flexible covering 50—e.g. flanges 54, eyelets or a perforated metal band for receiving fasteners 60 or some other arrangement—and any other appropriate consideration. Similarly, the shape of the spine 30 may be changed to suit the application.

The protective covering 50 is fastened to the spine 30 at one end and to an adjacent or neighbouring spine 30 at its other end. A series of spines 30 and protective coverings 50 may, therefore, be used to provide corrosion protection along the length or area of the sheet pile wall 10 that is to be protected. A single spine 30 may provide one surface for attaching to one flexible covering 50, and another surface for attaching to a neighbouring flexible covering 50. Similarly, a vertical length of wall 10 can be protected by applying numerous lengths of the protection assembly 100, in a horizontal orientation as shown in FIGS. 1 and 2. A small overlap between the flexible coverings 50 of vertically adjacent protection assemblies 100 may be used—this may warrant the lowermost fastener or fasteners of an upper flexible covering extending through the fixing portion of both the upper flexible covering and the flexible covering immediately below it. Similarly, numerous lengths of spine may also be used, preferably butting against one another.

The protective covering 50 is joined to the spine 30 by mechanical fasteners 60. A plurality of fasteners 60 is associated with each spine 30. The fasteners 60 are for attaching one of the fixing portions of the flexible covering 50 to the respective elongate member or spine 30 at spaced locations along the respective elongate member or spine 30, as shown in FIG. 3.

The fasteners 60 may form part of the wall anchor system 104, or may form part of the flexible covering 50, or both. The mechanical fasteners 60 may be integral with the wall anchor system 104 or flexible covering 50. In the embodiment shown in FIG. 2, the fasteners 60 extend or pass through holes in the fixing portions 54 to attach to the wall anchor system 104. In the preferred embodiment in FIG. 1, the mechanical fasteners 60 are stud bolts that are screwed or molded in the spine 30 and protrude out from the angled face of the spine 30. Other methods of fastening the protective covering 50 to the spine 30 may be used including bolts that are screwed directly into the spine 30 or into threaded inserts embedded into the spine 30. The threaded inserts may be moulded or screwed into the spine 30, or retained by an appropriately shaped hole made in the face of the spine 30 that faces the surface of the sheet pile wall 10. In this embodiment, a hole of diameter equal to, or slightly smaller than, the outer diameter of the threaded insert may be created in the face of the spine 30 facing the wall 10 in use. A smaller diameter hole, the diameter of which is approximately the outer diameter of the shank of a fastener 60, may be bored through from one of faces 118, 120 in coaxial alignment with the hole into which the threaded insert was installed. Thus, a fastener 60 subsequently inserted through face 118, 120 can engage the threaded insert, yet the threaded insert is not susceptible to being pulled, by the bolt, out of the hole into which it is installed.

Figure 7:
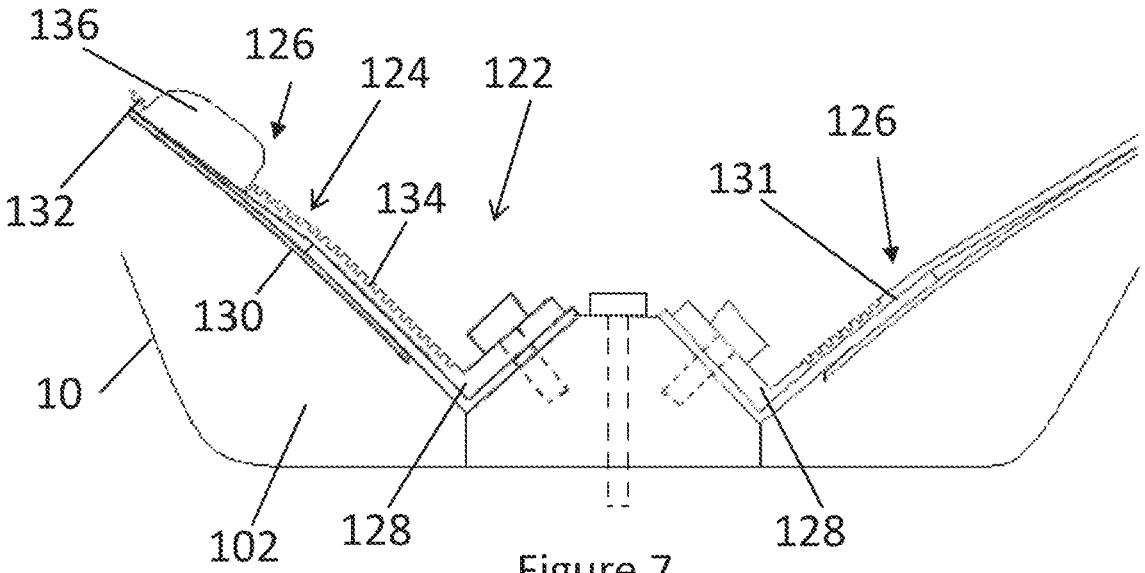
FIG. 7 is an alternative embodiment of a protection assembly in accordance with present teachings.

The embodiment described with reference to FIGS. 1 and 2 involves a flexible covering 50 comprising a sheet 52, and the integrity of the protection assembly relies on the sheet 52 being capable of maintaining tension while withstanding the environment 16. In an alternative embodiment, in the protection assembly 122 of FIG. 7 the flexible covering 124 comprises straps 126, and each of the fixing portions 128 comprises a respective one of two opposed ends of each strap 126. In some embodiments, a single strap may be used and, in other embodiments, multiple straps may be used. In either case, the straps 126 may provide the entirety of the pressure or force across the flexible covering 124 towards the wall 10, or the straps 126 and sheet 130 of the flexible covering 124 may both be placed under tension so as to provide that force.

Where multiple straps 126 are provided, the straps 126 may extend substantially in parallel across the flexible covering 124. In particular, the straps 126 may extend between opposed end regions of the flexible covering 124. The straps 126 may be spaced apart in a direction perpendicular to the direction of extension of the straps 126—i.e. perpendicular to the direction extending between opposed ends of the straps 126—with a fixing portion 128 being provided at each opposed end.

The straps 126 may directly retain the coating system 102 in position. However, for extra protection per the embodiment shown in FIG. 7, the flexible covering 124 will include both a sheet 130 and straps 126 holding the sheet 130 to the coating system 102. The straps 126 are then tensioned to apply at least a part of the force to press the coating system 102 towards or against the wall 10. The straps 126 may instead provide all of the force, however, it is also envisaged that the sheet 130 may be independently tensioned, or tensioned with the straps 126, so that the straps 126 and sheet 130 together apply the force to the coating system 102.

Each strap 126 comprises two sections 132, 134, with a buckle 136 connecting the sections. The strap 126 is operable to draw at least one of the sections 132, 134 through the buckle to apply tension to the strap 126. Such mechanisms are well understood and need not be described in greater detail herein.

Since, in some embodiments, the sheet 130 is not attached to the outer face of the spine 30 for tensioning purposes, that sheet 130 may bunch up during tensioning. An angled section 131 may therefore be attached to, or be integral with, the spine 30 to overlap the sheet 130. Thus, the end of the sheet 130 may be marginally shorter than the overall length of the straps 136 holding the sheet 130 to the coating system 102.

In the embodiments shown in each of the figures herein, the flexible covering 50, 124 may be tensioned by tensioning the fixing portions. In general, the fixing portion at one end of the flexible covering 50, 124 will be tensioned in an opposite or divergent direction to the fixing portion at the opposite end of the flexible covering 50, 124. In other words, the force pulling the flexible covering 50 at one end thereof acts in an opposite or divergent direction to the force pulling the flexible covering 50 at the other end. This is to be contrasted with sheets covering cylindrical piles, where the ends of the sheet are attached to one another and thus the force applied at one end converges upon the force applied at the other end of the sheet.

Sheet pile walls often have protrusions or wall fittings on their outside face, such as the nuts and washers from tie-backs and fasteners for waling beams. Such nuts, washers and the like may be used to anchor the wall to the soil or another structure. In some embodiments, the flexible coverings 50, 124 may be located so that the protrusions are within the depth of the shaping layer 40 and thus are neither exposed to the environment 16, nor come into contact with the flexible covering 50, 124, which contact might other damage the covering 50, 124.

Figure 4:
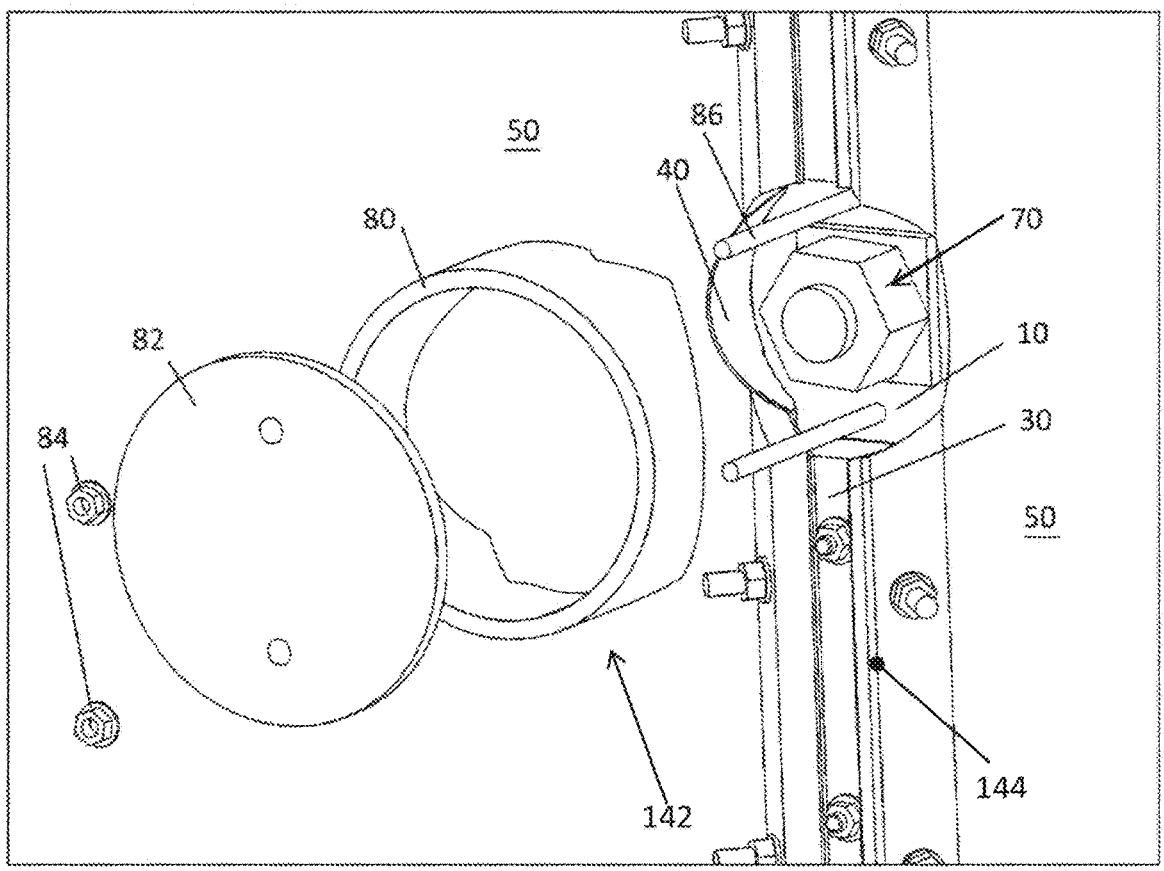
FIG. 4 is an exploded, isometric view of an encasement in accordance with present teachings, for application to a sheet pile wall over fixings located on the outside face of that wall, in combination with an assembly in accordance with present teachings.
Figure 5:
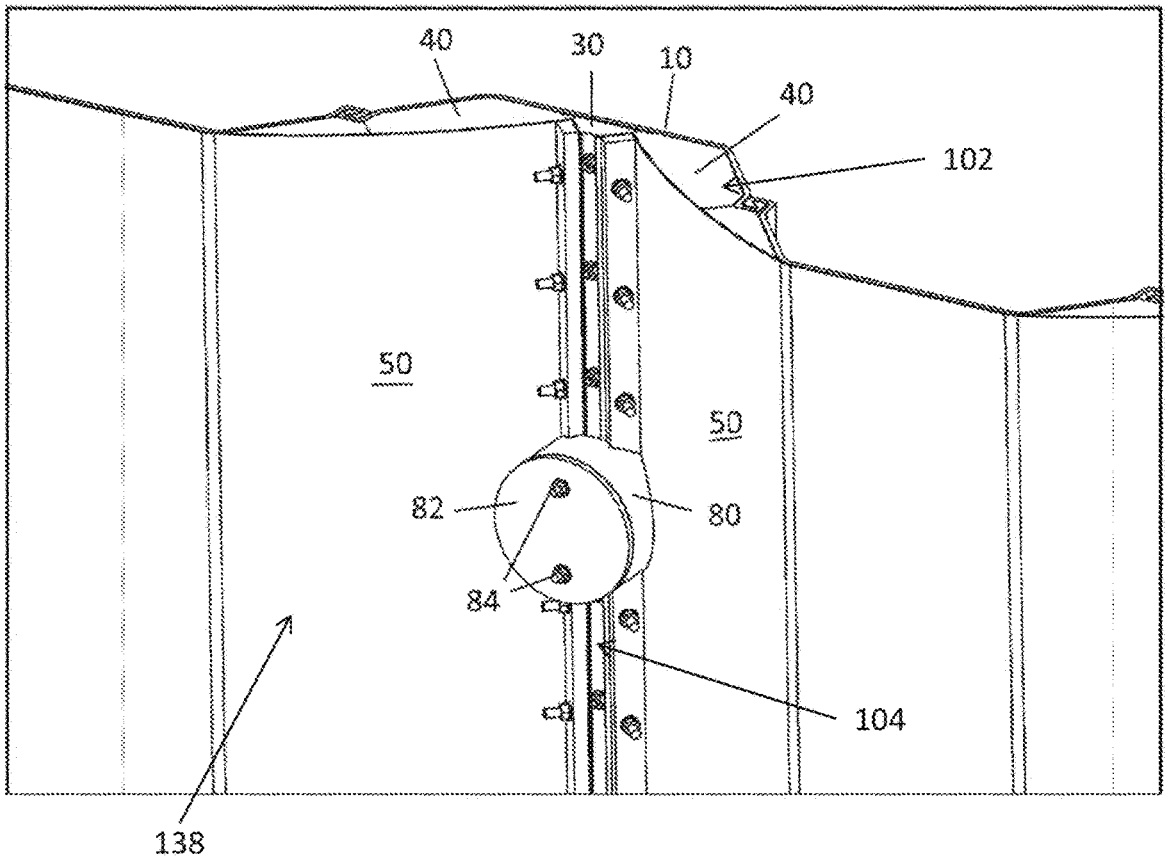
FIG. 5 is an isometric view of the assembly and encasement of FIG. 4, when applied to a sheet pile wall.
Figure 6:
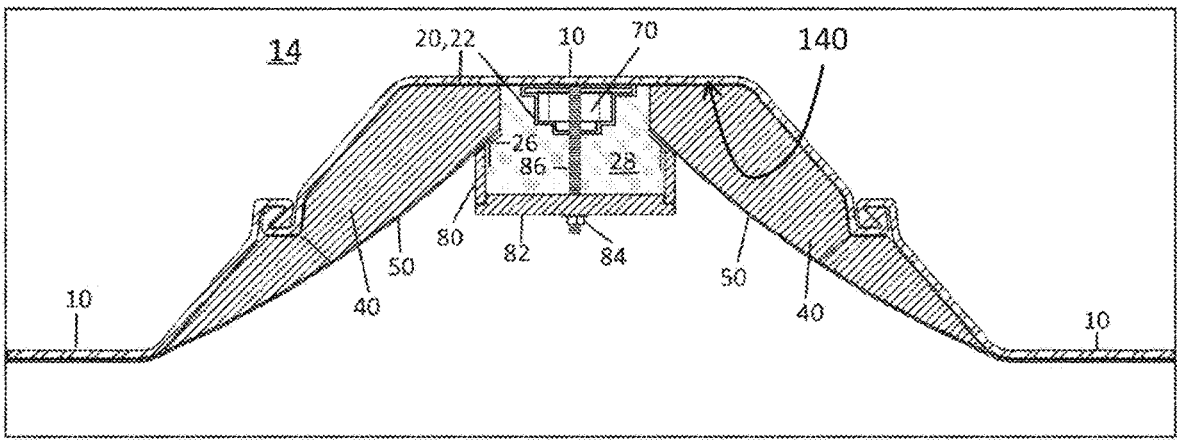
FIG. 6 is a cross-sectional view of the assembly and encasement of FIG. 5.

In other embodiments, a wall anchor system 104 may be located to pass through a protrusion or wall fitting such as shown in FIGS. 4 to 6. The protection assembly may therefore include means to cover or encase the wall fitting.

Regardless of where the wall fitting is located in the protection assembly, that assembly provides corrosion protection to the wall fitting while preventing damaging contact between the wall fitting and flexible covering or coating system as the case may be.

FIGS. 4 to 6 show an exploded view of a protection assembly 138 applied to a sheet pile wall 10 with a fastener or wall fitting 70 on its outside face 140. The fastener 70 is an example of a protrusion or wall fitting, consisting of a nut, washer and threaded bar, though other types of wall fitting are possible. The wall anchor system 104, presently spine 30 and fasteners 60, protective covering 50 and coating system 102 are trimmed to clear around the fastener 70. Those same components may instead be shaped—during fabrication or afterward—to clear the fastener 70 prior to being brought to site. However, trimming to fit on-site would more readily allow for fault tolerance.

The wall anchor system 104, protective covering 50 and coating system 102 may be cut in a circular fashion as shown, to provide clearance all around the fitting 70. Alternatively, a square cut or other shape may be used to suit the particular wall fitting and construction of the protection assembly 138. In any case, the protection assembly 138, particularly the flexible covering 50, is shaped to fit around the wall fitting or wall fittings.

An encasement 142 is then provided, to fit over the one or more fittings 70. The encasement 142 is shaped to be received over the wall fitting or fittings 70 and over an outer surface of one or more of the components of the protection assembly, namely one or more of the flexible cover 50, coating system 104 and wall anchor system 106. To that end, the encasement 142 comprises a section 80 that is profile cut to match the profile of the outside of the protective cover 50. The section 80 is then fit to the outer surface 144 of the protective cover 50. A lid 82 is held onto the section 80 by nuts 84 and studs 86, and tightening the nuts 84 pulls the section 80 against the protective cover 50. The lid 82 thereby seals an internal volume of the section 80 against ingress of water, sand and other contaminants. FIG. 4 shows a circular shape of the section 80 but other shapes are possible, such as rectangular. Thus, the encasement 142 is fitted to the outer surface 144 of the protection assembly component, being the flexible covering 50, wall anchor system 104 and/or coating system 102.

Referring to FIG. 6, the steel surface of the fastener 70 and surrounding surface of the sheet pile wall 10 are covered in the barrier material, e.g. anticorrosive gel 20, and the cloth or tape 22. Any gaps between the section 80 and the protective cover 50 or spine 30 may be filled with additional layers of tape 26 or other material. A compound 28 may then be used to fill the cavity made by, or volume of, the section 80 as seen in FIG. 6. The compound may be a lightweight, thick waterproof gel. The compound may comprise anticorrosive gel and fillers, or another compound as required by a particular application.

It will be appreciated that other shapes of encasement 142, profile cuts in the protection assembly 138, and encasement fillers may be used without departing from the teachings herein.

Figure 8:
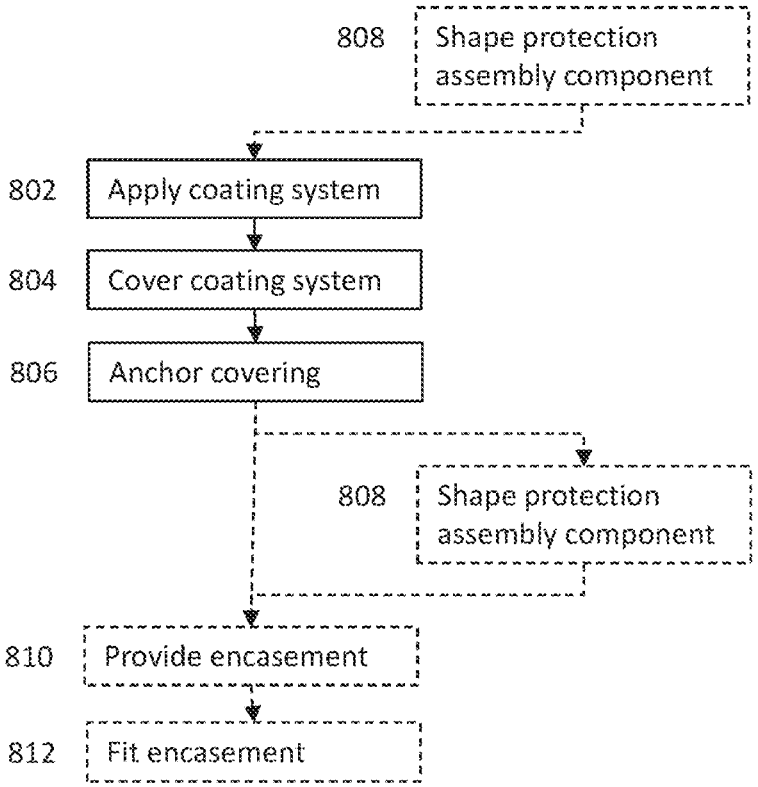
FIG. 8 illustrates a method for protecting a wall, in accordance with present teachings.

With reference to FIG. 8, the method 800 broadly describes the methods set out above for protecting a wall 10. The method 800 comprises:

Step 802: applying a coating system 102 to a portion of the wall 10;

Step 804: covering the coating system 102 with a flexible covering 50; and Step 806: anchoring the flexible covering 50, at its fixing portions, to the wall 10 using a wall anchor system 104.

In a specific embodiment of step 802, and with reference to FIG. 2, an anticorrosive gel 20 may be applied to the wall 10. A layer of tape 22 made from a cloth or foam material impregnated with further anticorrosive gel is applied over the gel 20. In deeply corroded and pitted areas as well as the joints 12 of the sheet pile wall 10 additional anticorrosive gel 24 or barrier material may be applied. Due to the volume, rather than a thin layer, that anticorrosive gel 24 is to occupy, anticorrosive gel 24 may have a formulation that is much stiffer than the gel 20 and may be reinforced with fibres or inert fillers. This additional gel is preferably applied before the tape 22, gives the finished surface of the tape 22 a more uniform profile and ensures anticorrosive gel is kept in contact with the surface of the steel sheet pile 10 in these areas. Thus, barrier material in layer 20 may be different from barrier material at gel locations 24.

As described above, the flexible covering 50 is anchored to the wall 10 in a tensioned condition. Since the flexible coating 50 is bent out of plane (e.g. follows a generally curved trajectory along the wall 10), this tension ensures the flexible covering 50 produces a force acting towards the wall 10 to press the coating system 102 against the wall 10. The flexible covering 50 may be tensioned during anchoring—e.g. by fasteners 60 pulling opposite ends of the flexible covering 50 away from each other during anchoring as discussed above—or may be tensioned before anchoring. For example, the flexible covering 50 may be pulled taut and then bolted onto wall anchor system 104, or straps may be used that, when tightened, apply the necessary tension—the flexible covering 50 is thus properly anchored when the tension is applied by the straps.

Accordingly, in some embodiments the wall anchor system 104 applies the tension, in other embodiments the flexible covering 50 applies the tension and, in still further embodiments, both may apply a part of the tension. In some cases, anchoring the flexible covering 50 will involve tensioning the flexible covering 50 in divergent directions. With reference to FIG. 3, the line of action of a force applied during tensioning one end of the flexible covering 50 onto one spine 30 (perpendicular to the surface of that spine 30, abutting flexible covering 50) acts towards the wall 10 in a direction divergent to that of the line of action of the force applied at the opposite end of the flexible covering 50. Thus, the forces applied during tensioning are applied in divergent directions. This is to be contrasted with protection assemblies used to protected circular section steel piles, in which the two ends are brought together during tensioning and the forces applied to the opposite ends during tensioning converge.

The method 800 can be used to protect a wall 10, that is elongate in a horizontal direction, from a marine environment. To facilitate this, the method 800 comprises installing a wall anchor system 104 across the wall 10, i.e. in the direction of extension or elongation of the wall 10, as shown in FIGS. 1 to 6. For each protection assembly 100, the wall anchor system 104 comprises two elongate members or spines 30 spaced along the wall 10, and a plurality of fasteners 60 associated with each elongate member or spine 30. In use, step 806 comprises fixing the two elongate members or spines 30 to the wall 10 at spaced apart locations, and then fastening one of the fixing portions of the flexible covering 50 to each elongate member using a respective one of the pluralities of fasteners 60.

Before attaching the spines 30, the layers 20 and 22 of the coating system 102 will first be applied to the wall 10. Then the spines 30, including any skirt 34, will be attached to the wall 10 through the layers 20, 22. The shaping layer 40 is then applied to the wall 10 between consecutive spines 30, before the flexible covering 50 is attached to the spines 30.

The method 800 can also be used to protect one or more wall fittings, such as fittings 70. Thus, in addition to performing steps 802, 804 806, the method 800 may further comprise:

Step 808: shaping the coating system 102, flexible covering 50 and/or wall anchor system 104 to fit around the one or more fittings;

Step 810: providing an encasement 142 shaped to be received over the one or more wall fittings 70 and over an outer surface 144 of a protection assembly component—i.e. the flexible cover 50, coating system 102 and/or wall anchor system 104; and Step 812: fitting the encasement 70 to the outer surface of the protection assembly component as discussed above with reference to FIGS. 4 to 6.

The embodiments described herein may be used to protect a wall 10 from a marine environment. Since the wall is elongate in the horizontal direction—e.g. parallel to an horizon or parallel to a water surface of the marine environment, accepting that waves and disturbances may vary that surface from time to time—the wall cannot be protected using standard protection systems that wrap around the structure they seek to protect and fasten back onto themselves. Instead, the wall is protected using a protection assembly as described herein, with fixing portions being anchored at spaced apart locations in the horizontal direction of the wall 10.

The protection assemblies 100 and methods for their use, as described herein may be used to protect elongate structures such as walls 10 located in marine environments. In some embodiments, the protection assemblies 100 may be applied to a sheet pile wall 10 which is composed of U-type sheet piles, combined wall composed of Z-type sheet piles or other structures of various and varying cross-section. The tension applied to the flexible covering 50 results from forces being applied at the wall anchor system 104, to opposite end regions of the flexible covering 50, in divergent directions. This cannot be achieved using protection assemblies designed to wrap around circular section piles and columns, which are able to clamp back onto themselves (i.e. where the opposite ends of the covering are brought together) to apply tension.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers. As used herein and unless otherwise stated, the term "approximately" means ±20%.

It must be noted that, as used in the specification and the appended claims, the singular forms "a," "an," and "the" include plural referents unless the context clearly dictates otherwise. Thus, for example, reference to "a support" includes a plurality of supports. In this specification and in the claims that follow, reference will be made to a number of terms that shall be defined to have the following meanings unless a contrary intention is apparent.

It will of course be realised that whilst the above has been given by way of an illustrative example of this invention, all such and other modifications and variations hereto, as would be apparent to persons skilled in the art, are deemed to fall within the broad scope and ambit of this invention as is herein set forth.

The claims defining the invention are as follows:

1. A protection assembly for protecting a wall, the wall being one of a sheet pile wall and a combined wall including sheet piles, the wall being elongate in a horizontal direction and having a non-planar profile suhc that an outer surface of the wall includes at least one of angles and changes in cross section, the protection assembly comprising:

a coating system for coating a portion of the wall;

a flexible covering for covering the coating system, and having fixing portions at end regions of the flexible covering; and a wall anchor system, wherein, in use:

the coating system is located between the flexible covering and the wall, the flexible covering is anchored, at the fixing portions, to the wall by the wall anchor system, the fixing portions are anchored to the wall at spaced apart locations in the horizontal direction, and the coating system is shaped so that the flexible covering follows a generally convex path between the fixing portions, wherein the coating system includes:

a barrier material layer that is applied to an outer surface of the wall in use; and a shaping layer disposed under pressure between the barrier material and the flexible covering, the shaping material having a first side that faces the wall in use and an opposing second side that is covered by the flexible covering and that defines, between the fixing portions, a generally convex curve different from the wall profile, wherein the first side of the shaping layer follows the non-planar profile of the wall and accommodates the angles and/or changes in cross-section in the outer surface of the wall, such that the shaping layer is shaped to remove voids between the flexible covering and the barrier material, and wherein the wall anchor system is operable to apply tension to the flexible covering, so the flexible covering is in hoop tension and produces a force to press the coating system against the wall.

2. The protection assembly of claim 1, wherein the flexible covering comprises a flexible sheet, and the end regions are opposed ends of the flexible sheet.

3. The protection assembly of claim 1, wherein the flexible covering comprises one or more straps, and each of the fixing portions comprises a respective one of two opposed ends of each strap of the one or more straps.

4. The protection assembly of claim 3, wherein the flexible covering further comprises a flexible sheet held, in use, against the coating system by the one or more straps, and wherein the one or more straps are tensioned to produce at least a part of the force to press the coating system towards the wall.

5. The protection assembly of claim 3, wherein each strap of the one or more straps comprises:

two sections, each section comprising one of the respective two opposed ends; and a buckle connecting the sections, the strap being operable to draw at least one of the sections through the buckle to apply tension to the respective strap.

6. The protection assembly of claim 1, wherein the fixing portions are tensioned in divergent directions.

7. The protection assembly of claim 1, wherein the wall anchor system comprises:

two elongate members each fixed, in use, to the wall at spaced apart locations; and a plurality of fasteners associated with each elongate member and being for fastening one of the fixing portions to the respective elongate member at spaced locations along the respective elongate member.

8. The protection assembly of claim 1, being for protecting the wall from a marine environment.

9. The protection assembly of claim 1, wherein the wall is non-planar, and the coating system is shaped so that the flexible covering applies force to press the coating system against the wall along a full length of the flexible covering.

10. The protection assembly of claim 1, wherein the flexible layer is shorter in length than the path between the fixing points, causing the flexible layer to deform.

11. A method for protecting a wall, the wall being one of a sheet pile wall and a combined wall including sheet piles, the wall being elongate in a horizontal direction and having a non-planar profile such that an outer surface of the wall includes at least one of angles and changes in cross section, the method comprising:

applying a coating system to a portion of the wall;

covering the coating system with a flexible covering having fixing portions at end regions of the flexible covering; and anchoring the flexible covering, at its fixing portions, to the wall using a wall anchor system, wherein:

anchoring the flexible covering at its fixing portions comprises anchoring the fixing portions to the wall at spaced apart locations in the horizontal direction, the coating system is shaped so that the flexible covering follows a generally convex path between the fixing portions, wherein the coating system includes:

a barrier material layer that is applied to an outer surface of the wall in use; and a shaping layer disposed under pressure between the flexible covering and the barrier material, the shaping material having a first side that faces the wall in use and an opposing second side that defines, between the fixing portions, a generally convex curve which is different from the wall profile, wherein the first side of the shaping layer follows the non-planar profile of the wall and accommodates the angles and/or changes in cross-section in the outer surface of the wall, such that the shaping layer is shaped to remove voids between the flexible covering and the barrier material, and the wall anchor system applies tension to the flexible covering, so the flexible covering is in hoop tension and produces a force to press the coating system against the wall.

12. The method of claim 11, wherein anchoring the flexible covering at its fixing portions comprises tensioning the flexible covering in divergent directions.

13. The method of claim 11, wherein the flexible covering comprises one or more straps, each strap comprising two opposed ends, each fixing portion comprising one of the opposed ends, and anchoring the flexible covering comprises:

attaching the one or more straps to the wall anchor system;

and tightening the one or more straps.

14. The method of claim 13, wherein the flexible covering further comprises a flexible sheet and covering the coating system comprises covering the coating system first with the flexible sheet and then holding the flexible sheet to the coating system using the one or more straps.

15. The method of claim 11, being for protecting the wall from a marine environment, wherein the wall anchor system comprises: two elongate members; and a plurality of fasteners associated with each elongate member, for fastening one of the fixing portions to the respective elongate member at spaced locations along the respective elongate member, wherein anchoring the flexible covering comprises:

fixing the two elongate members to the wall at spaced apart locations; and fastening one of the fixing portions to the respective elongate member using a respective one of the pluralities of fasteners.

16. The method of claim 11, further comprising shaping the coating system so that the flexible covering applies force to press the coating system against the wall along a full length of the flexible covering.

17. The method of protecting one or more wall fittings, comprising: performing the method of claim 11;

shaping the flexible covering to fit around one or more wall fittings;

providing an encasement shaped to be received over the one or more wall fittings and over an outer surface of a protection assembly component, the protection assembly component being one or more of the flexible cover, coating system and wall anchor system;

and fitting the encasement to the outer surface of the protection assembly component.

18. The method of protecting one or more wall fittings of claim 11, wherein the flexible layer is shorter in length than the path between the fixing points, causing the flexible layer to deform.

* * * * *